United States Patent [19]

Koerner

[11] 4,116,433

[45] Sep. 26, 1978

[54] CLIMBING TYPE GYMNASTIC APPARATUS

[76] Inventor: Dieter F. Koerner, 2701 E. Ironwood Dr., Phoenix, Ariz. 85028

[21] Appl. No.: 718,947

[22] Filed: Aug. 30, 1976

[51] Int. Cl.[2] ..... A63G 9/00

[52] U.S. Cl. ..... 272/85; 272/112

[58] Field of Search ..... 272/113, 112, 109; 182/199; 46/132, 27, 28, 29, 16, 17; 43/105; 35/18 A, 34, 60; 249/98; 52/83, 73, DIG. 10, 648; 248/318, 317; 47/44, 67; 34/239, 5 H; 220/18; D30/42; D48/16 R; 211/498, 85, 118

[56] References Cited

U.S. PATENT DOCUMENTS

| | | | |
|---|---|---|---|
| 241,098 | 8/1976 | Durfee et al. | 47/67 X |
| 312,354 | 2/1885 | Ivester | 182/199 |
| 544,100 | 8/1895 | Hurst | 43/105 |
| 2,064,826 | 12/1936 | Gabriel | 47/67 X |
| 2,843,379 | 7/1958 | Merritt | 272/113 X |
| 3,342,008 | 9/1967 | Frey | 52/73 X |
| 3,695,617 | 10/1972 | Mogilner et al. | 46/29 X |

FOREIGN PATENT DOCUMENTS

| | | | |
|---|---|---|---|
| 403,223 | 12/1967 | Australia | 47/67 |
| 443,086 | 1/1968 | Switzerland | 272/109 |

*Primary Examiner*—Richard C. Pinkham
*Assistant Examiner*—William R. Browne
*Attorney, Agent, or Firm*—Harry M. Weiss

[57] ABSTRACT

Freely suspended climbing apparatus of gymnastic apparatus that can be utilized both indoors and outdoors. The gymnastic apparatus has three triangular shaped elements which are spaced from each other and each of three elements is mounted on three separate ropes. Each of the three triangular elements has three elongated members preferably having a square shaped cross section and made of wood. The members making up each of the triangular shaped elements are mounted so that one end of each of the members is in overlapping contact with only one of the two other members. The other end of each of the members is in underlapping contact with the other of the two members. Thus, each member has one end thereof which is free to move upwards along the rope threaded through an opening in that end. Each of the three ropes are knotted below the bottom-most member at the three juncture points of each of the three triangle shaped elements to prevent the three members making up each of the triangle shaped elements from dropping from its fixed position. The gymnastic apparatus can be used both for climbing and for providing a swinging sensation when the apparatus is suspended from a chain-type structure. Additionally, the gymnastic apparatus can be rotated like a "top" when it is rotatably suspended from a support member.

3 Claims, 1 Drawing Figure

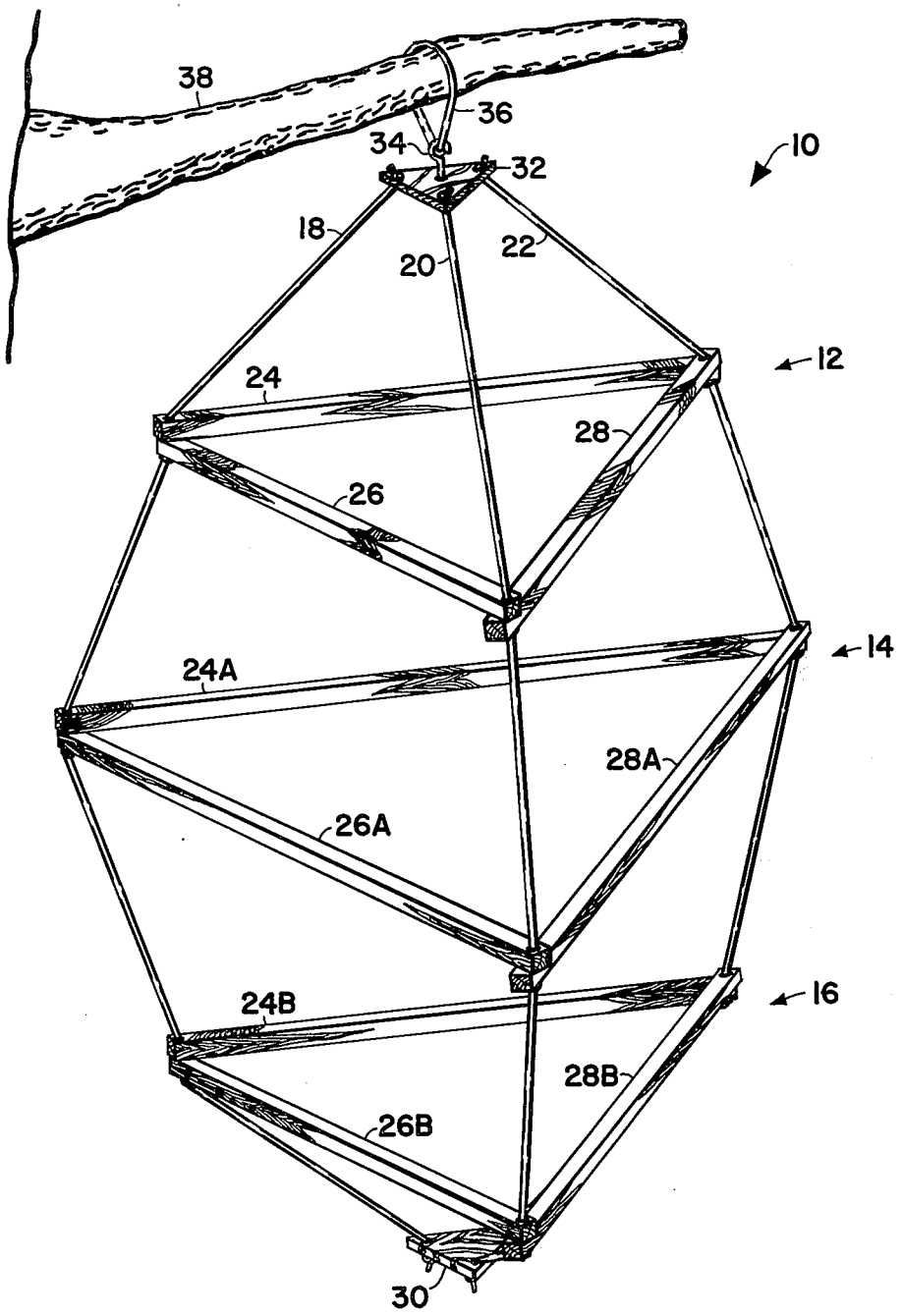
38
36
34
32
10
18
20
22
12
24
28
26
14
24A
28A
26A
16
24B
28B
26B
30

CLIMBING TYPE GYMNASTIC APPARATUS

BACKGROUND OF THE INVENTION

1. Field of the Invention

This invention relates generally to a gymnastic apparatus and, more particularly, to a gymnastic apparatus capable of being mounted for use indoors or outdoors such as on a children's swing set and can provide climbing, swinging and rotating functions.

2. Description of the Prior Art

In the past, various gymnastic apparatus have been devised for use for children in order to provide them with recreational facilities. One standard form of gymnastic apparatus which has been very popular is the rectangular bars known as "monkey bars" which consists of a plurality of vertical and horizontal bars attached together to form cubes with the bottom-most vertical bars usually imbedded in a fixed permanent position in the ground. One disadvantage associated with "monkey bars" is that they were often a source of injuries to children due to the rigid construction thereof including the usual use of metal bar members which very often created injurious accidental blows on portions of the bodies of children.

Another common gymnastic apparatus that was popularly used by children in the past and is still being used today is the simple swing which consists of a flat metal or wooden rectangular piece connected at each end by long metal chains which are used to swing a child or person in a pendulum-like manner. One problem with this simplified swing is that it often became very tedious after only a few minutes of use because of the relative swinging monotony that was created.

A need existed to develop a gymnastic apparatus that could have both the swinging movement of a swing and the climbing features of a "monkey bar" apparatus. Furthermore, a gymnastic apparatus was needed that would also provide rotational movement and a variety of movable structures to provide different apparatus configurations.

SUMMARY OF THE INVENTION

Accordingly, it is an object of this invention to provide an improved gymnastic apparatus.

It is a further object of this invention to provide a gymnastic apparatus which permits a child or user to attain swinging and climbing actions.

It is still another object of this invention to provide a gymnastic apparatus which utilizes movable bars for obtaining different configurations for climbing or gymnastic purposes.

It is still a further object of this invention to provide a gymnastic apparatus that would permit climbing, swinging and rotational actions.

BRIEF DESCRIPTION OF THE INVENTION

The sole FIGURE is a perspective view showing one embodiment of the gymnastic apparatus of this invention mounted, for example, outdoors on the limb of a tree.

DESCRIPTION OF THE SPECIFICATION

Referring to the sole FIGURE, reference numeral 10 generally depicts one embodiment of the gymnastic apparatus of this invention. The gymnastic apparatus 10 is preferably comprised of three triangular shaped elements generally designated by numerals 12, 14 and 16 and has an overall height of 7 or 8 feet depending on use indoors or outdoors, respectively. Preferably, these triangular shaped elements are made of three wood members such as, for example, pieces of wood 24 to 28 inches long, depending on location and desired configuration, and having a height and width of 2 inches. If desired, the pieces making up the triangular shaped elements 12, 14 and 16 can be made of other materials such as metal, fibreglass, glass, plastic, etc. While three members are shown in the FIGURE for each triangular shaped element 12, 14 or 16, it should be readily apparent that a single integral triangular shaped member can be utilized, if desired, to form one or more than one of the triangular shaped elements 12, 14 and 16. However, an important advantage is associated with the formation of the triangular shaped elements 12, 14 and 16 using three separate members for one or more of the elements in that each of the three members has one free end portion that overlaps an end portion of an adjacent member thereby permitting a portion of each member containing the free end portion to be moved in a substantially upward vertical direction which will provide a greater degree of flexibility for use of the gymnastic apparatus. Thus, with this greater degree of flexibility, various geometric configurations can be attained with the gymnastic apparatus thereby providing varying bar or member and rope combinations for the gymnastic apparatus.

Each of the triangular shaped elements 12, 14 and 16 are preferably mounted on three separate ropes 18, 20 and 22. It is also possible that a single rope could be utilized in place of the three separate ropes 18, 20 and 22; however, it is simpler to utilize the three separate ropes in rapidly assembling the gymnastic apparatus 10. The triangular shaped element 12 consists of three members 24, 26 and 28 which are provided in an overlapping arrangement of the end portions thereof in order to permit the one free end of each member to be moved in a substantially upward vertical movement. The free end of member 24 overlaps the one end of the member 26 at the location where the rope 18 is threaded through or connected to the adjacent ends of members 24 and 26. A knot is placed in the portion of the rope 18 that is located below the bottom surface portion of the member 26 in order to prevent downward movement of the member 26. Similarly, the member 26 has a free end portion overlapping the adjacent end portion of member 28 at the location where rope 20 is threaded through or connected to the two adjacent ends of members 26 and 28. A knot is also placed in the rope 20 below the bottom surface portion of the held end of the member 28. Similarly, a knot is located in the rope 22 below the bottom surface portion of the held end of the member 24. While holes are used at the ends of the members 24, 26 and 28 for the ropes, other connection techniques can be used to hold the three members in a triangular shaped configuration.

Thus, it can be readily seen from the embodiment of the FIGURE that the user of the gymnastic apparatus can have the freedom of moving the free end portions of each of the members 24, 26 and 28 that form the triangular shaped element 12 thereby providing greater latitude and flexibility in using various combinations of structural arrangements of the gymnastic apparatus including subsequent movement of the formerly held end portions of the members 24, 26 and 28. Therefore, once the overlapped free end portion of any one of the members 24, 26 and 28 is moved vertically upwardly, then the adjacent member can be moved vertically upwards both at the free end portion and at the portion of the initially held member.

The description with respect to the triangular shaped element 12 and its manner of assembly and location in the gymnastic apparatus 10 is substantially similar to the description of the triangular shaped element 14 and accordingly, reference numerals 24A, 26A and 28A, identifying the three members of the element 14, are analogous to the members 24, 26 and 28 of the triangular shaped element 12. However, as can be seen by reference to the drawing, the pieces 24A, 26A and 28A of the triangular shaped element 14 are preferably shown to be made of longer members than those of the triangular shaped element 12.

With respect to triangular shaped element 16, members 24B, 26B and 28B of the triangular shaped element 16 substantially corresponds to members 24, 26 and 28 of the triangular shaped element 12. In the embodiment of the FIGURE, the size of the members 24B, 26B and 28B of element 16 are all the same and are also equivalent in size to members 24, 26 and 28 of triangular shaped element 12. While the specific embodiment shown in the drawing utilizes longer members 24A, 26A and 28A than the corresponding members 24, 26 and 28 or 24B, 26B and 28B, if desired, all of the members of the triangular shaped elements 12, 14 and 16 could be made of the same thereby providing a cylindrically shaped gymnastic apparatus rather than the substantially barrel shaped configuration shown in the FIGURE. Similarly, two or more than three triangular shaped elements can be utilized in providing the gymnastic apparatus of this invention. A cone shaped configuration can be achieved by having, for example, elements 12 and 14 made of long members and element 16 made with shorter members. An hourglass shaped configuration can also be achieved by having shorter members for the element 14 and longer members for the elements 12 and 16.

The bottom end portions of ropes 18, 20 and 22 are knotted below a connecting plate or board 30 which is preferably made of wood and serves to connect up the bottom end portions of the three separate ropes. While the plate 30 is shown to be in triangular form, it can take whatever shape is desired in order to perform the function of connecting the three ropes to a single fixed connection member. Similarly, a connecting plate or board 32 is used for the purpose of connecting the upper end portions of the ropes 18, 20 and 22 which have knots therein on top of connecting plate 32.

A hook 34 is shown preferably rotatably mounted in the upper connecting plate 32 and is used for the dual purpose of swingably connecting the gymnastic apparatus 10 to a chain 36 which is located, for example, on a limb of a tree 38 and also to permit the gymnastic apparatus 10 to be rotated like a top. If desired, either the hook 34 alone or the chain and hook combination can be mounted indoors on a upper beam of a ceiling of a basement or other room of a home in order to permit someone to use the gymnastic apparatus of this invention indoors.

As is evident from the description of the gymnastic apparatus, a child or person can climb the various pieces of the gymnastic apparatus or the ropes associated therewith and do all kinds of gymnastic maneuvers in various combinations using any one or more of the triangular shaped elements or the ropes associated therewith. This would provide the user of the gymnastic apparatus with countless permutations and combinations of different gymnastic positions. Furthermore, the user would have the ability to achieve swinging or rotational motion during his use of the gymnastic apparatus which would provide further degress of movement and thereby enhance the enjoyment.

While the invention has been particularly shown and described in reference to the preferred embodiments thereof, it will be understood by those skilled in the art that changes in form and details may be made therein without departing from the spirit and scope of the invention.

What is claimed is:

1. A freely suspended climbing apparatus comprising, in combination:

(a) a plurality of rope-like members, (b) at least two spaced bar-type element means mounted on said rope-like members for providing bar-type supports for climbing or gymnastic use, (c) said spaced bar-type element means comprising at least a pair of separate triangular shaped elements, (d) said plurality of rope-like members comprising three ropes supporting each of said triangular shaped elements spaced apart on said three ropes, (e) said spaced bar-type element means comprising three separate triangular shaped elements spaced apart from each other on said three ropes, and (f) said triangular shaped elements each consisting of three separate bar-type members, one end of each of said three separate bar-type members overlapping the end of the adjacent bar-type member.

2. A freely suspended climbing apparatus as defined in claim 1

(a) means for permitting rotation of said bar-type element means and said rope-like members;

(b) means connected to said rotation means for permitting swinging movement of said bar-type element means and said rope-like members;

(c) said at least a pair of separate triangular shaped elements consists of three separate bar-type members, one end of each member of said three separate bar-type members overlapping the end of the adjacent bar-type member.

3. A freely suspended climbing apparatus as defined in claim 1 wherein:

(a) said three ropes being connected together beneath the bottom most of said triangular shaped elements.

* * * * *